US010403450B2

(12) United States Patent
Tourrette et al.

(10) Patent No.: US 10,403,450 B2
(45) Date of Patent: Sep. 3, 2019

(54) DEVICE FOR CONTROLLING A ZIP-CLOSURE SYSTEM OF AN ARTICLE AND CORRESPONDING ARTICLE

(71) Applicant: TOURRETTE INVESTISSEMENTS, La Rochelle (FR)

(72) Inventors: Philippe Tourrette, La Rochelle (FR); Alexandre Faucher, Bordeaux (FR)

(73) Assignee: TOURRETTE INVESTISSEMENTS, La Rochelle (FR)

( * ) Notice: Subject to any disclaimer, the term of this patent is extended or adjusted under 35 U.S.C. 154(b) by 155 days.

(21) Appl. No.: 15/557,914

(22) PCT Filed: Mar. 17, 2016

(86) PCT No.: PCT/FR2016/050594
§ 371 (c)(1),
(2) Date: Sep. 13, 2017

(87) PCT Pub. No.: WO2016/146951
PCT Pub. Date: Sep. 22, 2016

(65) Prior Publication Data

US 2018/0047526 A1 Feb. 15, 2018

(30) Foreign Application Priority Data

Mar. 19, 2015 (FR) ..... 15 52279

(51) Int. Cl.
*H01H 9/54* (2006.01)
*A41D 1/00* (2018.01)
(Continued)

(52) U.S. Cl.
CPC ..... *H01H 9/54* (2013.01); *A41D 1/005* (2013.01); *A41D 1/06* (2013.01); *A44B 19/02* (2013.01);
(Continued)

(58) Field of Classification Search
CPC . H01H 9/54; H01H 1/12; A41D 1/005; A41D 1/06; A44B 19/02; A44B 19/24; A45F 3/04
(Continued)

(56) References Cited

U.S. PATENT DOCUMENTS 4,603,327 A 7/1986 Leonard et al.
7,304,600 B2 12/2007 Nehls
(Continued)

FOREIGN PATENT DOCUMENTS

DE 102011075455 8/2012
EP 0303481 2/1989
WO 9724042 7/1997

OTHER PUBLICATIONS

Office Action dated Mar. 29, 2018.
Search Report dated Nov. 26, 2015.

*Primary Examiner* — Eric Blount
(74) *Attorney, Agent, or Firm* — Ipsilon USA, LLP

(57) ABSTRACT

The invention relates to a monitor device for monitoring the closed or open state of an article, the monitor device being in the form of an electronic circuit comprising a zip closure system comprising two strips, each having fastened thereto a row of elements, referred to as "teeth" (11, . . . , 14, 20, . . . , 25), which elements are made of electrically conductive material. A slider (3) is mounted to slide along the strips and is configured, in one direction, to cause the teeth of one row to mesh with the teeth of the other row, and in the other direction, to separate the teeth. A detector-and-signaling device (4) is connected firstly to at least one of the teeth, referred to as a "first terminal" (21), and secondly to at least one of the other teeth, referred to as a "second terminal" (24). The detector-and-signaling device is configured to detect the state of electrical continuity between the first and second terminals (21, 24), and to issue a signal as a function
(Continued)

of said detected continuity state. The first terminal (21) and the second terminal (24) are spaced apart from each other by at least one tooth (22, 23), said at least one tooth having no electrical connection with said terminals when the teeth of the two rows are in the separated state.

17 Claims, 4 Drawing Sheets

(51) Int. Cl.

| | |
|---|---|
| ***A41D 1/06*** | (2006.01) |
| ***A45F 3/04*** | (2006.01) |
| ***H01H 1/12*** | (2006.01) |
| ***A44B 19/02*** | (2006.01) |
| ***A44B 19/24*** | (2006.01) |
| *A45F 3/00* | (2006.01) |

(52) U.S. Cl.
CPC ..... *A44B 19/24* (2013.01); *A45F 3/04* (2013.01); *H01H 1/12* (2013.01); *A41D 2300/322* (2013.01); *A45F 2003/001* (2013.01); *H01H 2001/125* (2013.01)

(58) Field of Classification Search
USPC ..... 340/571, 540, 687
See application file for complete search history.

(56) References Cited

U.S. PATENT DOCUMENTS

| | | | | |
|---|---|---|---|---|
| 7,450,014 | B2 | 11/2008 | Farhadian | |
| 8,179,255 | B1 * | 5/2012 | Lamore | G08B 13/1436 340/539.13 |
| 10,192,421 | B2 * | 1/2019 | Tourrette | A44B 19/24 |
| 2009/0195400 | A1 * | 8/2009 | Oreshkin | A41D 1/002 340/686.1 |
| 2010/0038276 | A1 * | 2/2010 | Chen | A44B 19/24 206/527 |
| 2010/0136804 | A1 | 6/2010 | Strickland | |

* cited by examiner

DEVICE FOR CONTROLLING A ZIP-CLOSURE SYSTEM OF AN ARTICLE AND CORRESPONDING ARTICLE

RELATED APPLICATION

This application is a National Phase of PCT/FR2016/050594, filed on Mar. 17, 2016 which in turn claims the benefit of priority from French Patent Application No. 15 52279, filed on Mar. 19, 2015, the entirety of which are incorporated by reference.

BACKGROUND

Field of the Invention

The present invention relates to a monitor device for monitoring the closed or open state of a closure system for an article such as a bag, baggage, a pair of trousers, a pair of shorts, a skirt, or some other analogous garment. The present invention also relates to the corresponding article.

Description of Related Art

Certain transport articles, such as bags or baggage, include a closure system of the zip closure type. When a bag remains open, or opens involuntarily, there is a risk of losing its content. In similar manner, there is a risk of the content of the bag being stolen if the bag is open, unknown to its proprietor.

Furthermore, trousers usually include a fly that can likewise be formed by a closure system of the zip closure type. It can happen that the fly remains open or partially open, which constitutes a risk of embarrassing third parties if the wearer of the trousers does not notice quickly.

The state of the art, and in particular document EP 0 303 481, discloses devices enabling the state of a zip closure system to be monitored. In an embodiment of document EP 0 303 481, the monitor device comprises a detector-and-signaling device with two connectors, one connected to teeth of one row of a zip closure and the other connected to teeth of the other row of the closure. The teeth to which the connectors are connected face each other in such a manner that the connectors are at the same level, and that, when the zip closure level with the connectors is in the closed state, said connectors are brought into contact with each other, thereby closing an electrical circuit in which there flows a current coming from an electrical power supply. The flow of this current is detected by the detector-and-signaling device, which can deduce therefrom the open or closed state of the zip closure, and can signal that state.

Nevertheless, in the prior solution disclosed in document EP 0 303 481, and as mentioned above, the connectors are arranged at the same height along the zip closure, so there exists a non-negligible risk of the connectors touching each other, even when the zip closure is not closed. The detector-and-signaling device then does not signal the open state of the zip closure since the detector-and-signaling device detects contact between the connectors.

Also, the fact of connecting one of the connectors to one side of the zip closure and the other connector to the opposite side of the zip closure makes it necessary to pass the connection wires all around the trousers, which is complicated and increases the risk of the device being damaged.

OBJECTS AND SUMMARY

An object of the invention is to propose a novel device for monitoring the closed or open state of an article having a zip closure, and enabling the above-described problem to be solved in full or in part.

For this purpose, the invention provides a monitor device for monitoring the closed or open state of an article, such as an article of clothing or an article of baggage, the monitor device being in the form of an electronic circuit comprising both a zip closure system comprising:

- two strips, each having fastened thereto a row of elements, referred to as "teeth", which elements are made of an electrically conductive material; and
- an element, referred to as a "slider", mounted to slide along the strips and configured, in one direction, to cause the teeth of one row to mesh with the teeth of the other row, and in the other direction, to separate the teeth; and
- also a detector-and-signaling device connected firstly to at least one of the teeth, referred to as a "first terminal", and secondly to at least one of the other teeth, referred to as a "second terminal";
- and in that the detector-and-signaling device is configured to detect the state of electrical continuity between the first and second terminals, and to issue a signal as a function of said detected continuity state;

the monitor device being characterized in that, in a direction parallel to the rows of teeth in the meshed state of said teeth, the first terminal and the second terminal are spaced apart from each other by at least one tooth of the zip closure system, said at least one tooth having no electrical connection with said terminals when the teeth of the two rows are in the separated state.

Having said first and second terminals of said zip closure system spaced apart by at least one tooth makes it possible to limit the risk of inopportune contact between the first and second terminals, thereby making the device for monitoring the closed or open state of the article more reliable.

According to an advantageous characteristic of the invention, the detector-and-signaling device is connected to said first terminal by a conductive filamentary element such as an electric wire or a conductive textile line, and to said second terminal by another conductive filamentary element.

According to an advantageous characteristic of the invention, the first or second conductive filamentary element respectively connected to the first or second terminal is also connected to at least one other neighboring tooth forming a portion of the zip closure system, said other neighboring tooth and said first or second terminal forming respective portions of the same row of teeth.

According to an advantageous characteristic of the invention, the first or second conductive filamentary element is connected respectively to said first or second terminal, and preferably to said at least one other tooth, by winding an end portion of said conductive filamentary element respectively about said first or second terminal.

According to an advantageous characteristic of the invention, the first and second terminals form portions of the same row of teeth.

In a variant embodiment, the first terminal forms part of one of the two rows of teeth and the second terminal forms part of the other row of teeth.

In a particular aspect, with said detector-and-signaling device being referred to as the "first" signaling device, the monitor device further comprises a second detector-and-signaling device that is connected firstly to a third tooth and secondly to a fourth tooth, and the second detector-and-signaling device is configured to detect the state of electrical continuity between the third and fourth teeth, and to issue a signal as a function of said detected state of continuity.

Each strip is formed by a textile piece, e.g. a strip of woven fabric.

In a particular aspect, said detector-and-signaling device comprises both a signaling module, e.g. of sound and/or vibratory and/or light type, and also a detector module configured to detect the state of electrical continuity between the first and second terminals, and for activating the signaling module as a function of said state of continuity.

Advantageously, said monitor device includes sealing means configured so that said detector-and-signaling device is waterproof.

Said or each detector-and-signaling device includes a timer module governing the signaling module.

According to an advantageous characteristic of the invention, the or each detector-and-signaling device includes wireless transmission means configured to transmit a signal that is a function of the detected state of continuity to an appliance that is distinct from the detector-and-signaling device, such as a mobile telephone.

According to an advantageous characteristic of the invention, the device includes:

both a power supply closure system comprising first and second electrically conductive elements that are electrically connectable and disconnectable relative to each other, with at least the first element comprising a hollow body; and also an electrical power supply, preferably a button cell, housed in the hollow body, said electrical power supply having a positive pole and a negative pole, one of the poles being electrically connected to the hollow body of the first element, and the other pole being connected to an electrically conductive element having means electrically insulating it from the hollow body and passing through said hollow body; and the detector-and-signaling device comprises both a detector module configured to be powered by the power supply when the power supply closure system is in the closed state and to detect the open or closed state of the zip closure system, and also a signaling module configured to issue a signal as a function of the open or closed state of the zip closure system as detected by the detector module.

Preferably, the first terminal of said zip closure system is electrically connected to the circuit via the positive pole of the power supply, and the second terminal of said zip closure system is connected to an input of the detector module, the signaling module being connected to an output of said detector module.

According to an advantageous characteristic of the invention, the positive pole of the power supply is electrically connected to the hollow body of the first element, and the negative pole of the power supply is connected to said conductive element that passes through the hollow body of the first element.

According to an advantageous characteristic of the invention, the detector module has a power supply input connected to the circuit via the positive pole of the power supply by the second element of the power supply closure system.

According to an advantageous characteristic of the invention, the first terminal of the zip closure system is electrically connected to the second element of the power supply closure system.

According to an advantageous characteristic of the invention, said device includes a timer module configured to introduce a time delay between the moment when a detection signal is issued at the output from the detector module and activating the signaling module.

In a particular embodiment, the detector module comprises a logic NOT gate having an input terminal connected to the second terminal of the zip closure system and an output terminal connected to the input of the signaling module.

Advantageously, said timer module is interposed between the logic NOT gate and the signaling module.

In a particular embodiment, the detector-and-signaling device comprises a processor-and-calculation unit such as a microprocessor or a microcontroller, said unit including a set of computer instructions forming said detector module; and in that said processor-and-calculation unit includes a detector input to which the second terminal of the zip closure system is connected, and said detector module is configured to detect a voltage greater than a threshold value being applied to said detector input.

In a particular aspect, the detector-and-signaling device includes a signaling module connected to the output of the processor-and-calculation unit.

According to an advantageous characteristic of the invention, the detector-and-signaling device includes a wireless communication module configured to transmit information representative of the closed or open state of the closure system to a receiver module.

The invention also provides an article presenting an openable portion fitted with a closure system, the article preferably being an article of clothing, such as a pair of trousers openable in the middle at the front, or a jacket presenting an openable pocket, and being characterized in that said article is provided with a monitor device as described above, said closure system of the article being said zip closure system of the monitor device.

In a particular embodiment, said article is a pair of trousers and the zip closure system forms a fly.

Advantageously, the power supply closure system forms the closure button situated level with the trouser waistband.

The invention also provides baggage, such as a backpack, presenting an openable portion fitted with a closure system, said baggage being characterized in that it is provided with a monitor device as described above, said closure system of the baggage being said zip closure system of the monitor device.

The invention also provides a kit for a zip closure system, said kit comprising first and second conductive filamentary elements and a detector-and-signaling device configured to detect and signal a state of electrical continuity, said conductive filamentary elements being for connecting to teeth made of conductive material of a zip closure and to the detector-and-signaling device for detecting and signaling a state of electrical continuity in order to form a monitor device as described above.

The invention also provides a kit for a zip closure system of an openable portion of an article and enabling a monitor device as described above to be fabricated, said kit comprising:

both a power supply closure system comprising first and second electrically conductive elements that are electrically connectable and disconnectable relative to each other, with at least the first element comprising a hollow body; and also an electrical power supply housable in the hollow body, said electrical power supply having a positive pole and a negative pole, one of the poles being suitable for being electrically connected to the hollow body of the first element, and the other pole being suitable for being connected to an electrically conductive element having means electrically insulating it from the hollow body and passing through said hollow body; and a detector-and-signaling device comprising both a detector module configured to be powered by the power supply when the power supply closure system is in the closed state and to detect the open or closed state of said zip closure system for closing the openable portion of the article, and also a signaling module configured to issue a signal as a function of the open or closed state of said zip closure system as detected by the detector module.

BRIEF DESCRIPTION OF THE DRAWINGS

The invention can be well understood on reading the following description of embodiments given with reference to the accompanying drawings, in which.

DETAILED DESCRIPTION

With reference to the figures and as mentioned above, the invention relates to a monitor device for monitoring the closed or open state of a zip closure system I5. Advantageously, said zip closure system I5 is fitted to an article 100 that presents a re-closable opening 101. By way of example, said article may be a bag or a pair of trousers, as described in detail below.

The monitor device is in the form of an electronic circuit. The monitor device also comprises a detector-and-signaling device 4 for detecting and signaling the closed or open state of the zip closure system I5.

An electrical power supply device 5, 9 serves to control the supply of power to the device 4 for detecting and signaling the closed or open state of the zip closure system I5.

Figure 1:
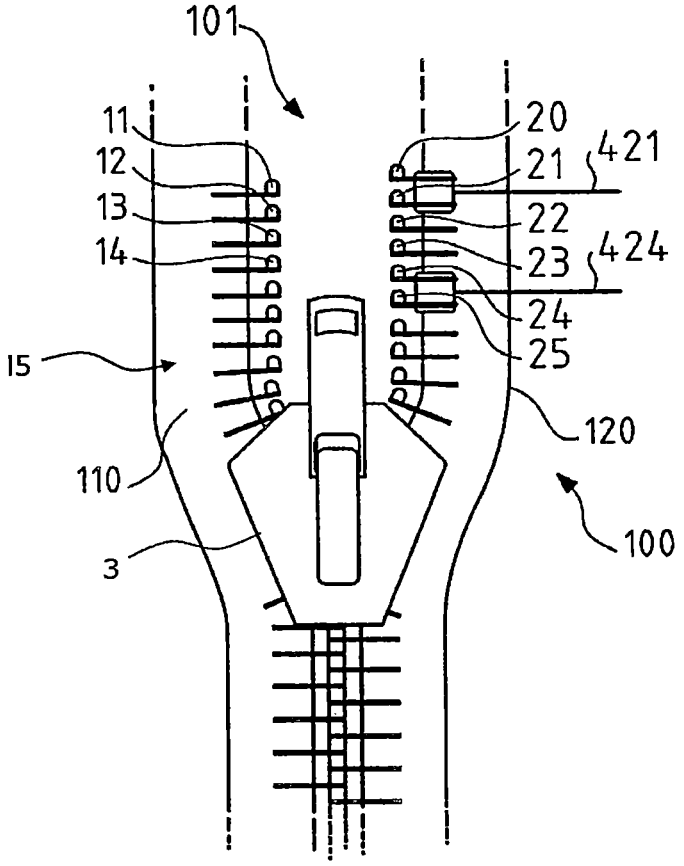
FIG. 1 is a diagrammatic view of a zip closure in accordance with an embodiment of a closure system used in a monitor device of the invention.

As mentioned above, the zip closure system I5 serves to close at least in part the opening 101 formed in the article 100. As shown in FIG. 1, said article 100 includes in particular a portion 110 that defines one edge of the opening, and a portion 120 that defines the opposite edge of the opening. In the closed state of the opening, said opposite edges defined by the portions 110 and 120 are brought one against the other.

In general manner, the zip closure system I5 presents two rows of teeth made of electrically-conductive material that are capable of being coupled and uncoupled relative to each other, so that in the state in which the elements of one row are coupled with the teeth of the other row, electrical continuity is established along the teeth. Conversely, in the non-coupled state of the teeth, absence of electrical continuity appears between the teeth.

In the example shown in FIG. 1, the zip closure system I5 comprises two strips, each having fastened thereto a row of elements, referred to as "teeth" 11, 12, 13, 14, 20, 21, 22, 23, 24, 25, which elements are made of an electrically conductive material. Said strips correspond to the portions 110 and 120 that define between them the re-closable opening 101.

An element 3, referred to as a "slider", is mounted to slide along the strips. The slider 3 is configured so that in one direction it causes the teeth of one row to mesh with the teeth of the other row, and in the other direction it separates them. One of the teeth forms a first terminal 21 and another tooth forms a second terminal 24, as described in detail below.

Each strip 110 and 120 is formed by a textile piece, e.g. a strip of woven fabric.

One of the teeth forms a first terminal 21 and another tooth forms a second terminal 24, as described in detail below. The detector-and-signaling device 4 is connected to said first terminal 21 by a conductive filamentary element 421, such as an electric wire or a conductive textile line, and to said second terminal 24 by another conductive filamentary element 424, which may be of the same type as the conductive filamentary element 421.

Whatever embodiment, the detector-and-signaling device 4 is configured to detect the absence of electrical continuity between the first and second terminals 21 and 24, and to issue a signal as a function of the detected absence of continuity.

When the teeth of said rows are in the mutually coupled state, the first terminal 21 and the second terminal 24 are spaced apart from each other in a direction parallel to the rows of teeth by at least one tooth 22, 23. When the rows are in the uncoupled state, said at least one tooth 22, 23 has no electrical connection with either of said first and second terminals 21 and 24. Preferably, said first and second terminals 21 and 24 are thus spaced apart by at least two or three teeth in order to limit any risk of inopportune contact between the first and second terminals 21 and 24.

Preferably, the first or the second conductive filamentary element 421, 424 as connected respectively to the first or to the second terminal 21, 24 is also connected to at least one neighboring tooth 20, 25. Said at least one neighboring tooth 20, 25 and said first or second terminal 21, 24, as the case may be, form parts of the same row of teeth.

The first or second conductive filamentary element 421, 422 is connected respectively to said first or second terminal 21 or 24, and preferably to said at least one additional neighboring tooth, by winding an end portion of said conductive filamentary element 421, 424 respectively about said first or second terminal.

Advantageously, the first and second terminals 21 and 24 form portions of the same row of teeth. Such a design for the device enables the conductive filamentary elements 421, 424 to extend on one side only of the opening 101, thereby avoiding any need to go all around the article in order to get to the other side of the opening 101. In a variant, provision may be made for the first terminal 21 to form a portion of one of the two rows of teeth and for the second connection terminal 24 to form a portion of the other row of teeth.

The electrical power supply device 5, 9 includes a closure system 9 comprising a first element 6 and a second element 7 that are electrically connectable and disconnected relative to each other. The closure system 9 forms a switch that is closed in the coupled-together state of said elements (i.e. when they are electrically in contact with each other), and that is open in the uncoupled state of said elements (i.e. when there is no electrical contact between them). The closure system 9 is also referred to as the "power supply"

closure system since it serves, as described in detail below, to form an electric switch between the power supply 5 and the detector-and-signaling device 4.

Figure 3:
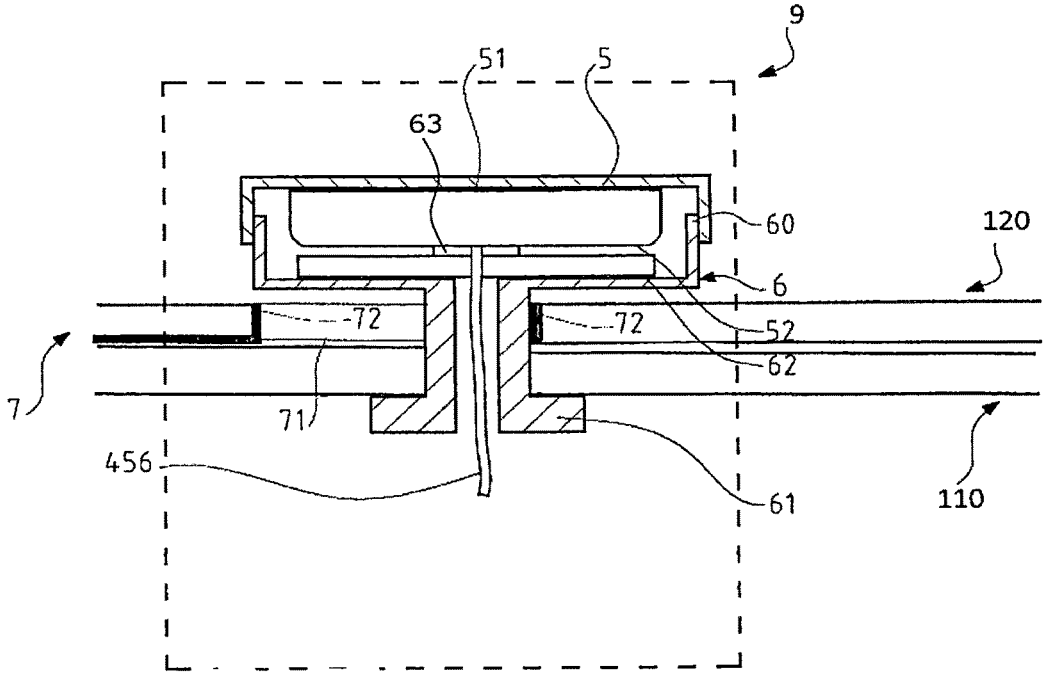
FIG. 3 is a diagrammatic view of a battery forming a button cell housed in the hollow body of a closure button for powering of the electronic circuit of a monitor device of the invention.

As shown in FIG. 3, the first element 6 comprises a hollow body 60. The hollow body 60 is made up of a plurality of parts that can be assembled and disassembled. Advantageously, the hollow body is made up of two parts that can be assembled together by screw-fastening, or that can be assembled together by elastic deformation, i.e. by clipping or by snap-fastening.

Said element 6 is made of electrically conductive material. In the example shown in the figures, the element 7 is also electrically conductive.

Preferably, the element 6 and the element 7 are of the male/female type. In particular, in the example shown in FIG. 3, the element 6 is a button having a hollow head 60 and a peg 61, and the element 7 comprises an eyelet 71 having electrically conductive means 72. By way of example, said eyelet is formed by a textile zone of the article having an opening provided therein for inserting the element 6. Said electrically conductive means may be formed by a conductive ink. In the example shown in FIG. 3, the conductive ink 72 is applied to the inside outline of the eyelet 7 with which the peg 61 of the button is in contact when the button 6 and the eyelet 7 are in the coupled state.

The element 6 then comes electrically into contact via its hollow body 60 and/or its peg 61 with said electrically conductive means 72 when the element 6 and the element 7 are in the coupled state. The element 7 may be connected to the remainder of the circuit by a conductive element in electrical continuity with said electrically conductive means 72, which conductive element may be a line of conductive ink or a preferably-insulated electric wire.

In a variant, said element 7 may be formed by a pierced conductive film or plate fitted on said corresponding portion of the article. In a variant, the element 6 may be the male portion of a press stud and the element 7 may be the female portion. In the example shown in FIG. 3, the closure button forming the element 6 is fastened to the portion 110 of the article, and the eyelet forming the element 7 is provided in the portion 120 of the article.

Preferably, the opening 101 provided between the first and second portions 110 and 120 can be reclosed by coupling the element 6 with the element 7 and by closing the closure system I5. For this purpose, when the first portion 110 of the article carries the element 6, the second portion 120 of the article is provided with said second element 7. In a variant, the element 6 could be on the second portion 120 and the element 7 in the first portion 110.

In a particular embodiment, said article is a pair of trousers. Under such circumstances, the first element 6 is a waistband button of the article, i.e. the button at the top of the pair of trousers located at waistband level. Said element 6 may thus be a closure button situated at the front and level with the waistband of the pair of trousers. This closure button is usually situated at the top of the fly. The corresponding element 7 is situated level with the front of the waistband, above the fly, and beside the other leg.

After putting on a pair of trousers, a user is expected to close the fly and attach the waistband button to the corresponding complementary element. When said fly is formed by the closure system I5, the device of the invention as described below serves to detect non-closure of said fly and to signal that it is open. Provision may also be made for the device to be adapted to detect closure of the fly and to signal that it is closed.

An electrical power supply 5 is housed in the hollow body 60 of said element 6. Advantageously and as shown in FIG. 3, said electrical power supply 5 is a battery of the button cell type.

In the example shown in FIG. 3, said electrical power supply 5 has a positive pole 51 electrically connected to the hollow body 60 of the first element 6, e.g. by pressing thereagainst. For this purpose, the hollow body 60 may house a spring 63 that serves to keep the positive pole 51 pressed against the hollow body.

The power supply 5 also has a negative pole 52 connected to an electric wire 456 that is provided with an insulating sheath and that passes through the hollow body 60 of the first element 6 without making electrical contact with said hollow body 60. The negative pole 52 is electrically insulated from the hollow body 60, e.g. by an insulating plate 62.

In the example shown in FIG. 3, the power supply 5 is a button cell. The positive pole is formed by one of the faces of the button cell and by its side wall, while the negative pole is formed by the other face of the battery and is separated from the positive pole by an electrically insulating gasket.

Figure 2:
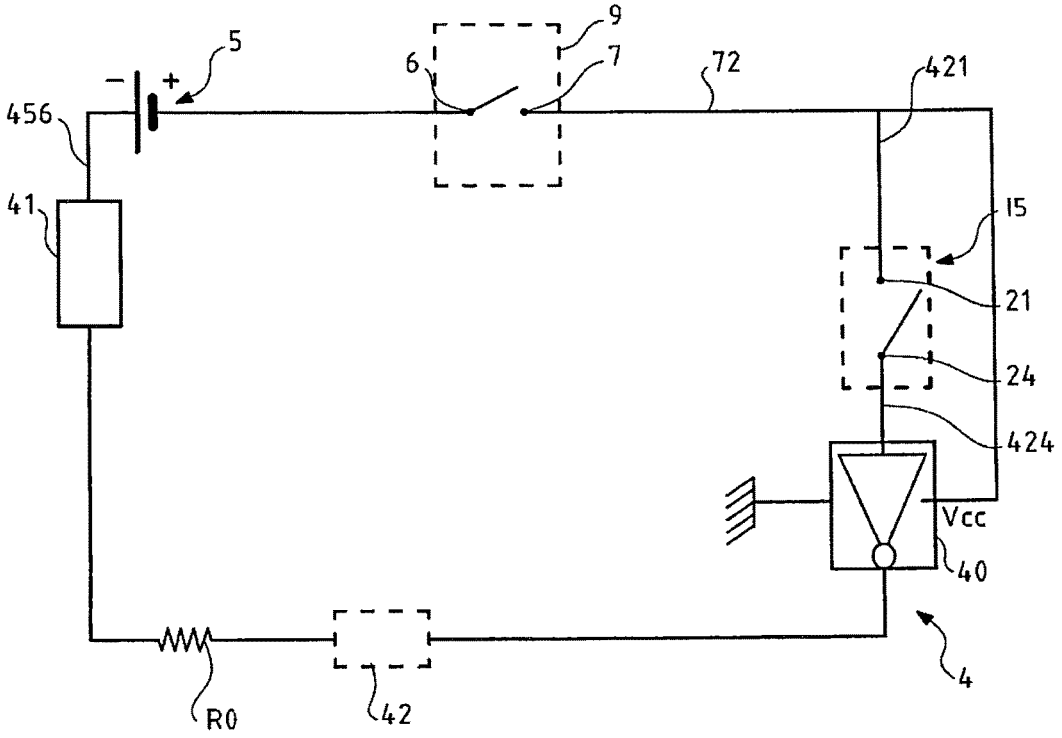
FIG. 2 is a diagrammatic view of an electronic circuit corresponding to a first embodiment of a closure monitor device of the invention.

FIG. 2 shows an embodiment of the monitor device that is made up of elements that are inexpensive compared with the embodiment described in greater detail below with reference to FIG. 4.

In the embodiment of FIG. 2, the first terminal 21 of the closure system I5 is electrically connected to the positive pole 51 of the power supply 5 by the closure system 9. In particular, the terminal 21 of the closure system I5 is connected to the element 7 of the closure system 9 by the electrically conductive wire 421, which is connected to the line 72. As mentioned above, the element 6 is electrically connected to the positive pole 51 of the power supply 5. The opposite terminal 24 of the closure system I5 is connected to the input of a detector module 40 by an electrically conductive wire 424.

The closure system 9 and the closure system I5 form switches that are connected in series with the input of the detector module. Also, in the example shown in FIG. 2, the closure system 9 constitutes a switch for the power supply Vcc of the detector module 40.

The detector module 40 is a logic NOT gate having an input terminal connected to the second terminal 24 of the closure system I5 and an output terminal connected to a timer module 42. The output from the timer module 42 is connected to the input of a signaling module 41. The signaling module 41 has one terminal connected to the negative pole of the power supply 5 via the conductive filamentary element 456. The signaling module 41 may be formed by an electrical or electronic member suitable, when its input is powered, for emitting a sound, vibratory, or light signal, or a radio signal. The signaling module 41 may thus be formed by a light-emitting diode (LED).

The logic NOT gate also has a power supply input Vcc connected to the positive pole 51 of the power supply 5. In particular, the power supply input Vcc is connected to the element 7 in such a manner that the detector module 40 is powered only when the switch 9 is closed.

Thus, when the switch 9 and the closure system I5 are closed, the electric circuit formed between the power supply 5 and the input terminal of the detector module 40 is powered.

The output from the logic NOT gate is then in the 0 state, preventing the signaling module 41 from being powered. Conversely, when the closure system I5 is open, the electric circuit formed between the power supply 5 and the input terminal of the module 40 is no longer powered and the output terminal from the module 40 changes to the 1 state in such a manner that the signaling module 41 is powered to emit a signal characteristic of the absence of closure of the system I5, preferably after a given time delay.

Advantageously, the timer module 42 as interposed between the detector module 40 and the signaling module 41 is configured to apply a time delay between the moment when a detection signal is issued at the output from the detector module 40, corresponding to the 1 state of the output of the NOT gate, and activating the signaling module 41.

A resistor R0 is interposed in the circuit in order to enable the device to operate properly.

Figure 4:
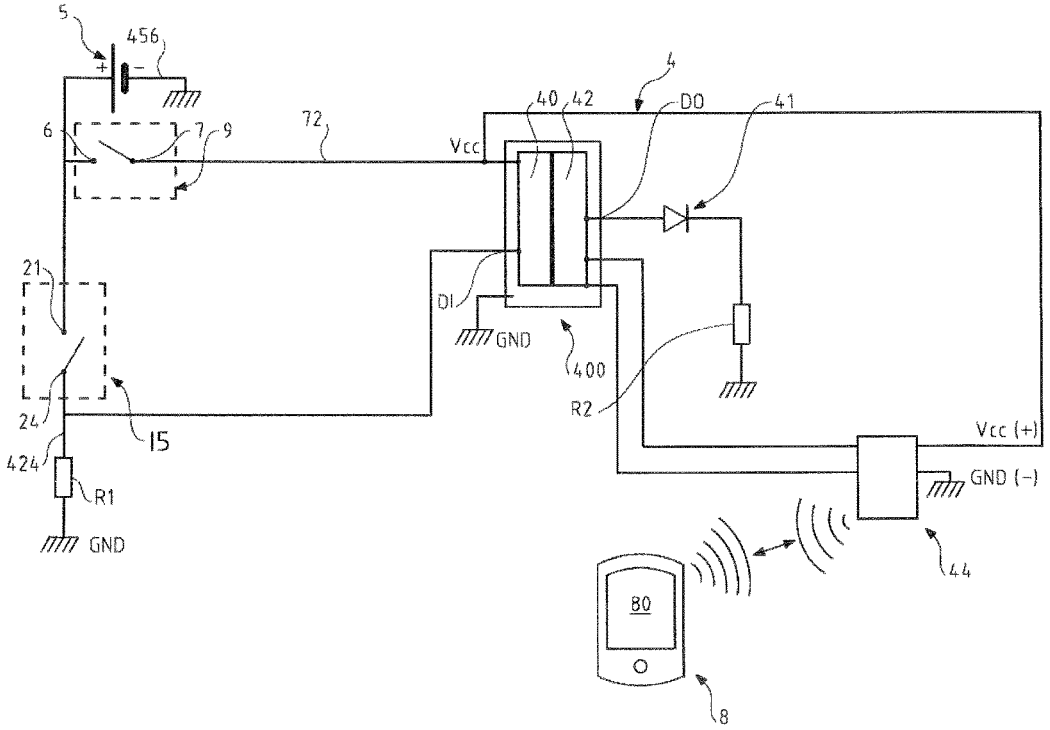
FIG. 4 is a diagrammatic view of an electronic circuit corresponding to a second embodiment of a closure monitor device of the invention.

In the example shown in FIG. 4, and in comparison with the example of FIG. 2, there can again be seen the power supply 5 having its positive pole connected to the element 6 of the closure system 9. In this example, the detector-and-signaling device 4 comprises an electronic and/or computer processor-and-calculation unit 400. In the example shown in FIG. 4, the unit is a microcontroller. In a variant, the unit may be a microprocessor with an associated memory. Stored in a memory of said microcontroller, said microcontroller includes a set of computer instructions forming said detector module 40. The timer module 42 is also formed by a set of stored instructions that are executable by the unit.

The conductive filamentary element 72 connects the element 7 to the power supply input Vcc of the processor-and-calculation unit 400. The terminal 21 is connected to the positive pole of the power supply 5. The terminal 24 of the closure system I5 is connected to a digital detector input DI forming said input to which the second terminal 24 of the closure system I5 is connected. Said detector module 40 is configured to detect a voltage greater than a threshold value being applied to said detector input. For this purpose, the input DI and the terminal 24 of the closure system I5 are connected to ground via a resistor R1 such that when the switch I5 is in the closed state, the detector module 40 detects the voltage of the power supply 5 across the terminals of said resistor R1.

Detecting said voltage corresponds to the closed state of the electric circuit between the power supply input Vcc of the unit 400, the closure system I5, and the detector input DI.

In the example shown in FIG. 4, the signaling module 41 is connected by one of its terminals to an output DO of the processor-and-calculation unit 400 and by another terminal to the electrical ground of the device via a resistor R2. The resistor R2 is adapted to ensure that the signaling module operates properly.

Said output DO serves to activate or not activate the signaling module 41 as a function of the state of the digital input DI. As shown in FIG. 4, the signaling module may be an LED having its anode connected to the output DO and having its cathode connected to ground via the resistor R2.

Advantageously, the detector-and-signaling device 4 includes a wireless communication module 44. The communication module 44 is configured to transmit the detected state of the closure system I5 to an external receiver module 80. By way of example, said external receiver module 80 forms part of a mobile electronic appliance 8, such as a smartphone or a tablet. The mobile appliance has a computer application configured to signal the closed or open state of said closure system I5, e.g. in visual, audible, or vibratory manner. As shown in FIG. 4, the communication module 44 may be connected to the unit 400 by a communication bus, and it is powered by the power supply 5 when the closure system 9 is in the closed state.

The fact of connecting the positive pole of the power supply 5 to the hollow body of the element 6 enables the element 6 to cooperate with the element 7 to form a power supply switch for the detector module 40, thereby making it possible to avoid consuming energy from the power supply 5 when the closure system I5, e.g. forming the fly of a pair of trousers, is open, while the closure system 9, e.g. forming the waistband button of the trousers, has still not been closed.

Whatever embodiment, the signaling module can issue a signal of sound and/or vibratory and/or light and/or radio type.

Said monitor device includes sealing means configured so that said detector-and-signaling device 4 is waterproof. Preferably, the first closure system 9 is also waterproof.

The detector and/or timer and/or communication and/or signaling modules may be made in the form of electronic components and/or in the form of computer programs. The computer programs, or computer instructions, or executable programs, may be contained in program storage devices, e.g. in computer-readable digital data storage media. The programs or instructions may also be executed from program storage peripherals.

The monitor device may be incorporated in an article of clothing, such as a pair of trousers that opens in the middle at the front, or a jacket having an openable pocket, presenting a portion that can be opened and reclosed.

The monitor device may also be incorporated in baggage having a portion that is openable and reclosable, such as a backpack.

With an article that presents one or more straps, such as a backpack, provision may be made for the closure system 9 that includes a first element 6 and a second element 7 that are electrically connectable and disconnectable to be positioned on a portion of the article, e.g. a strap, on its side that is to bear against the user. The element 6 and element 7 are then configured, e.g. like a pushbutton, to be put into electrical contact by pressing one against the other as a result of the weight of the article while the article is being carried by the user.

In other words, for an article that is carried by the user, such as a backpack, the closure system comprising the elements 6 and 7 may be configured so as to be closed automatically when the article is in its state of being carried by the user, with the element 6 and the element 7 then being electrically connected together. Said system may be closed by the closure system 9 bearing against the user under gravity. Otherwise, the element 6 and the element 7 may be urged into a position in which they are electrically disconnected from each other.

Provision may also be made for the monitor device to be in the form of a kit for a closure system that presents two rows of teeth, as described above. Said kit comprises first and second conductive filamentary elements 421 and 424 together with a detector-and-signaling device 4 configured to detect and signal a state of electrical continuity. Said conductive filamentary elements 421 and 422 are for connecting to the teeth of the zip closure and to the detector-and-signaling device 4 in order to form said first and second terminals of a closure system in which the detector-and-signaling device 4 serves to detect and to signal the open state.

Although at least one embodiment of the invention is illustrated and described, it should be observed that other modifications, substitutions, and alternatives may appear to the person skilled in the art and may be changed without going beyond the ambit of the subject matter described herein.

The present application seeks to cover all adaptations and variations of the above-described embodiments. Furthermore, the term "comprising" does not exclude other elements or steps, and the term "a" or "an" does not exclude the plural. Also, characteristics or steps described with reference to one of the above-described embodiments may equally well be used in combination with other characteristics or steps of other above-described embodiments.

The invention claimed is:

1. A monitor device for monitoring the closed or open state of an article, such as an article of clothing or an article of baggage, the monitor device being in the form of an electronic circuit comprising:

both a zip closure system comprising:

two strips, each having fastened thereto a row of elements teeth, which teeth are made of an electrically conductive material; and a slider, mounted to slide along the strips and configured, in one direction, to cause the teeth of one row to mesh with the teeth of the other row, and in the other direction, to separate the teeth; and also a detector-and-signaling device connected firstly to a first terminal that is at least one of the teeth, and secondly to a second terminal that is at least one of the other teeth;

wherein the detector-and-signaling device is configured to detect the state of electrical continuity between the first and second terminals, and to issue a signal as a function of said detected continuity state;

wherein, in a direction parallel to the rows of teeth in the meshed state of said teeth, the first terminal and the second terminal are spaced apart from each other by at least one tooth of the zip closure system, said at least one tooth having no electrical connection with said terminals when the teeth of the two rows are in the separated state.

2. A device according to claim 1, wherein the detector-and-signaling device is connected to said first terminal by a conductive filamentary element such as an electric wire or a conductive textile line, and to said second terminal by another conductive filamentary element.

3. A device according to claim 2, wherein the first or second conductive filamentary element respectively connected to the first or second terminal is also connected to at least one other neighboring tooth forming a portion of the zip closure system, said other neighboring tooth and said first or second terminal forming respective portions of the same row of teeth.

4. A device according to claim 3, wherein the first or second conductive filamentary element is connected respectively to said first or second terminal, and preferably to said at least one other tooth, by winding an end portion of said conductive filamentary element respectively about said first or second terminal.

5. A device according to claim 1, wherein the first and second terminals form portions of the same row of teeth.

6. A device according to claim 1, wherein said detector-and-signaling device comprises both a signaling module, and also a detector module for detecting the state of electrical continuity between the first and second terminals, and for activating the signaling module as a function of said state of continuity.

7. A device according to claim 1, wherein said monitor device includes sealing means configured so that said detector-and-signaling device is waterproof.

8. A device according to any preceding claim, wherein the device includes:

both a power supply closure system comprising first and second electrically conductive elements that are electrically connectable and disconnectable relative to each other, with at least the first element comprising a hollow body; and also an electrical power supply, preferably a button cell, housed in the hollow body, said electrical power supply having a positive pole and a negative pole, one of the poles being electrically connected to the hollow body of the first element, and the other pole being connected to an electrically conductive element having means electrically insulating it from the hollow body and passing through said hollow body; and wherein the detector-and-signaling device comprises both a detector module configured to be powered by the power supply when the power supply closure system is in the closed state and to detect the open or closed state of the zip closure system, and also a signaling module configured to issue a signal as a function of the open or closed state of the zip closure system as detected by the detector module.

9. A device according to claim 6, wherein the detector module comprises a logic NOT gate having an input terminal connected to the second terminal of the zip closure system and an output terminal connected to the input of the signaling module.

10. A device according to claim 1, wherein the detector-and-signaling device comprises a processor-and-calculation unit such as a microprocessor or a microcontroller, said unit including a set of computer instructions forming said detector module; and wherein said processor-and-calculation unit includes a detector input to which the second terminal of the zip closure system is connected; and wherein said detector module is configured to detect a voltage greater than a threshold value being applied to said detector input.

11. A device according to claim 10, wherein the detector-and-signaling device includes a signaling module connected to the output of the processor-and-calculation unit.

12. A device according to claim 10, wherein the detector-and-signaling device includes a wireless communication module configured to transmit information representative of the closed or open state of the closure system to a receiver module.

13. An article presenting an openable portion fitted with a closure system, and having a monitor device according to claim 1, said closure system of the article being said zip closure system of the monitor device.

14. An article according to claim 13, wherein said article is a pair of trousers and the zip closure system forms a fly.

15. An article according to claim 14, wherein the monitor device is in accordance with claim 8, and the power supply closure system forms the closure button situated level with the waistband of the trousers.

16. Baggage, such as a backpack, presenting an openable portion fitted with a closure system, wherein said baggage is provided with a monitor device according to claim 1, said closure system of the baggage being said zip closure system of the monitor device.

17. A kit for a zip closure system including a monitor device according to claim 1, said kit comprising first and second conductive filamentary elements and a detector-and-signaling device configured to detect and signal a state of electrical continuity, said conductive filamentary elements being for connecting to teeth made of conductive material of a zip closure and to the detector-and-signaling device for detecting and signaling a state of electrical continuity.

* * * * *